US008544960B2

(12) United States Patent
Klabisch et al.

(10) Patent No.: US 8,544,960 B2
(45) Date of Patent: Oct. 1, 2013

(54) CHAIN GUIDE FOR A DRIVING CHAIN OF A MINING MACHINE

(75) Inventors: Adam Klabisch, Dortmund (DE); Norbert Hesse, Bochum (DE); Gerhard Siepenkort, Lunen (DE); Klaus Duhnke, Werne (DE); Diedrich Bettermann, Unna (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 288 days.

(21) Appl. No.: 12/989,049

(22) PCT Filed: Apr. 21, 2009

(86) PCT No.: PCT/IB2009/051635

§ 371 (c)(1),
(2), (4) Date: Dec. 21, 2010

(87) PCT Pub. No.: WO2009/130667

PCT Pub. Date: Oct. 29, 2009

(65) Prior Publication Data

US 2011/0095595 A1 Apr. 28, 2011

(30) Foreign Application Priority Data

Apr. 22, 2008 (DE) ..... 20 2008 005 609 U

(51) Int. Cl.
*E21C 27/34* (2006.01)
*E21C 31/06* (2006.01)
*E21C 29/14* (2006.01)

(52) U.S. Cl.
USPC ..... 299/34.07; 299/34.09; 299/34.1

(58) Field of Classification Search
USPC ..... 299/34.1, 34.09, 34.01, 47, 48, 50, 299/34.07; 242/615, 615.1, 615.2
See application file for complete search history.

(56) References Cited

U.S. PATENT DOCUMENTS

| | | | | |
|---|---|---|---|---|
| 1,477,970 | A * | 12/1923 | McDaniel | 299/82.1 |
| 3,863,522 | A * | 2/1975 | Gibson et al. | 74/661 |
| 3,899,965 | A * | 8/1975 | Koch et al. | 100/155 R |
| 3,968,754 | A * | 7/1976 | Lanfermann et al. | 104/172.1 |
| 5,167,438 | A * | 12/1992 | Fiesel et al. | 299/34.1 |
| 5,624,162 | A * | 4/1997 | Guse et al. | 299/1.6 |
| 7,055,913 | B2 | 6/2006 | Eickelmann et al. | |
| 2005/0056527 | A1 | 3/2005 | Weigel et al. | |

FOREIGN PATENT DOCUMENTS

| | | | |
|---|---|---|---|
| DE | 849082 | | 9/1952 |
| DE | 1583784 | | 6/1971 |
| DE | 2504696 | A1 | 8/1976 |
| DE | 3017353 | A1 | 11/1981 |
| DE | 3927892 | A1 | 2/1991 |
| DE | 19537414 | A1 | 7/1997 |

(Continued)

*Primary Examiner* — David Bagnell
*Assistant Examiner* — Michael Goodwin
(74) *Attorney, Agent, or Firm* — Foley & Lardner LLP

(57) ABSTRACT

A chain guide for a driving chain of a winning plow or the like, the chain guide being provided with a chain guide element which is arranged in spatial proximity to the sprockets at a driving or return station and is against the chain transversely to the direction of movement of the latter, provision is made according to the invention for the chain guide element to have at least one pressure roller which can be adjusted against the chain links of the driving chain, as a result of which the wear on the chain guide element is considerably reduced.

10 Claims, 6 Drawing Sheets

(56) References Cited

FOREIGN PATENT DOCUMENTS

| | | | |
|---|---|---|---|
| DE | 202004000924 | U1 | 4/2004 |
| GB | 752038 | | 7/1956 |
| GB | 1467580 | | 3/1977 |

* cited by examiner

CHAIN GUIDE FOR A DRIVING CHAIN OF A MINING MACHINE

The invention relates to a chain guide for a driving chain of a mining machine, in particular for a plow chain for moving a winning plow, comprising driving and/or return stations which are provided on or can be arranged on end regions of the mining machine and have driving or return sprockets for the driving chain, and comprising at least one chain guide element which is arranged in spatial proximity to the sprockets at the driving and/or return station and can be adjusted, or is engaged in operational use, transversely to the direction of movement of the chain against its load strand and/or return strand.

BACKGROUND OF THE INVENTION

A chain guide arrangement on a mining machine is known (DE 20 2004 000 924 U) in which a chain guide element is formed by a hold-down device which has a pressure surface and can be inserted into an accommodating pocket in the region of the chain guide in such a way that it can be put, with a pin receptacle open on one side, onto a hinge pin arranged in the region of the accommodating pocket and is then pivoted about said hinge pin into the pocket until its bottom pressure surface presses against the driving chain and it can be locked in this position by a locking arrangement. It is possible to quickly exchange the hold-down device together with the pressure surface formed thereon for a new chain guide element of corresponding design, whereby downtimes in the event of wear of the pressure surface of the hold-down device can be minimized. At the same time, the known chain guide elements, past which the driving chain is moved with a considerable pressure force and at a considerable speed, is subjected to high wear, and therefore it is necessary to exchange it within relatively short time intervals in order to ensure the proper operation of the mining machine.

SUMMARY OF THE INVENTION

An object of the invention is to avoid these disadvantages and provide a chain guide of the type mentioned at the beginning with which the wear in the region of the chain guide element is markedly reduced.

This object is achieved by the invention in that the chain guide element has at least one pressure roller which is adjusted or can be adjusted against the chain links of the driving chain.

Through the use of a pressure roller on the chain guide element, sliding contact between said chain guide element and the driving chain is at least largely prevented, for the peripheral speed at which the pressure roller rotates is the same as the passage speed of the chain, against which it presses in order to guide it. Even if coal dust or other material, possibly also abrasive material, gets between chain and pressure roller, the wear caused by this on the pressure roller track, which in a preferred configuration of the invention can be adapted to the envelope curve defined by the chain links, is only slight, for which reason it is not necessary to exchange the chain guide element substantially formed by the pressure roller until after a period of use considerably longer than was the case with the chain guide elements used hitherto.

The pressure roller is preferably rotatably mounted on a roller axle and can be exchanged together with the latter. The roller axle, in a construction unit with the pressure roller which is rotatably mounted thereon, is then removed and exchanged for a corresponding new part, wherein the downtimes of the mining machine are reduced to a minimum. The pressure roller can then be arranged or mounted in an especially advantageous manner on an attachment which can be interchangeably inserted or is interchangeably inserted in the entry region of the driving and/or return station. In this especially advantageous design, the pressure roller is therefore arranged on an attachment which can be interchangeably inserted in an accommodating pocket and which can then also contain still further components of the chain guide, such as, for example, a catch, known per se, for the chain, said catch being used when the driving or return sprockets of the driving or return stations are exchanged in order to keep the chain tensioned during such maintenance work.

According to an advantageous configuration, the roller axle of the pressure roller can be supported on one or more bearing blocks which are preferably interchangeably fitted in an accommodating pocket. In this case, a bottom bearing block and a top bearing block can preferably be provided on both sides of the roller. In this configuration, the bearing blocks can more preferably be secured against release in the accommodating pocket by means of a preferably hinged lid. Alternatively, the bearing blocks can be secured against release in the accommodating pocket by means of at least one sliding bolt. In this configuration, it is especially advantageous if a top bearing block is provided with sliding guides for sliding bolts. The sliding guides can consist in particular of hook-like strips which vertically fix and at the same time guide in a horizontally movable manner the one sliding bolt or preferably the two sliding bolts displaceable relative to one another. In this case, retaining blocks having locking pockets which face one another are more preferably fitted above the accommodating pocket, and/or the sliding bolts have locking lugs which engage in the locking pockets in the locking state in order to secure the top bearing block against release in the locking state of the locking bolts.

In an especially preferred configuration having form-fitting bolt securing for the bearing blocks, a pair of sliding bolts are provided, wherein each sliding bolt has a U-shaped base having three legs, of which one marginal leg and an intermediate leg are provided, on outer sides facing away from one another, with guide strips for form-fitting engagement in sliding guides, and of which the second marginal leg has a through-hole for a securing screw. A bottom axle receptacle for the roller axle can be arranged directly at the bottom of the recess and can preferably be fixedly formed on or fastened to the attachment.

In particular if it is necessary to guide and keep under tension especially long and/or heavy chains using a chain guide element according to the invention, a design which has a plurality of pressure rollers which are arranged one behind the other in the passage direction of the chain and are adjusted against the chain can be advantageous, as a result of which the requisite, high pressure force can be distributed over a plurality of rollers and the surface pressures between chain and running surface of the pressure rollers can be kept low or reduced. The pressure roller can be adjusted against the chain under the effect of at least one spring element and/or of at least one shock absorber, thereby making it possible for the chain to yield in a direction transversely to its passage direction, for example if shock-like loads occur, but without the pressure roller lifting from the chain, not even temporarily, and thereby no longer being able to perform its guide function, even if only briefly.

These and other objects, aspects, features, developments, embodiments and advantages of the invention of this application will become apparent to those skilled in the art upon a reading of the Detailed Description of Embodiments set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF EMBODIMENTS

Figure 1:
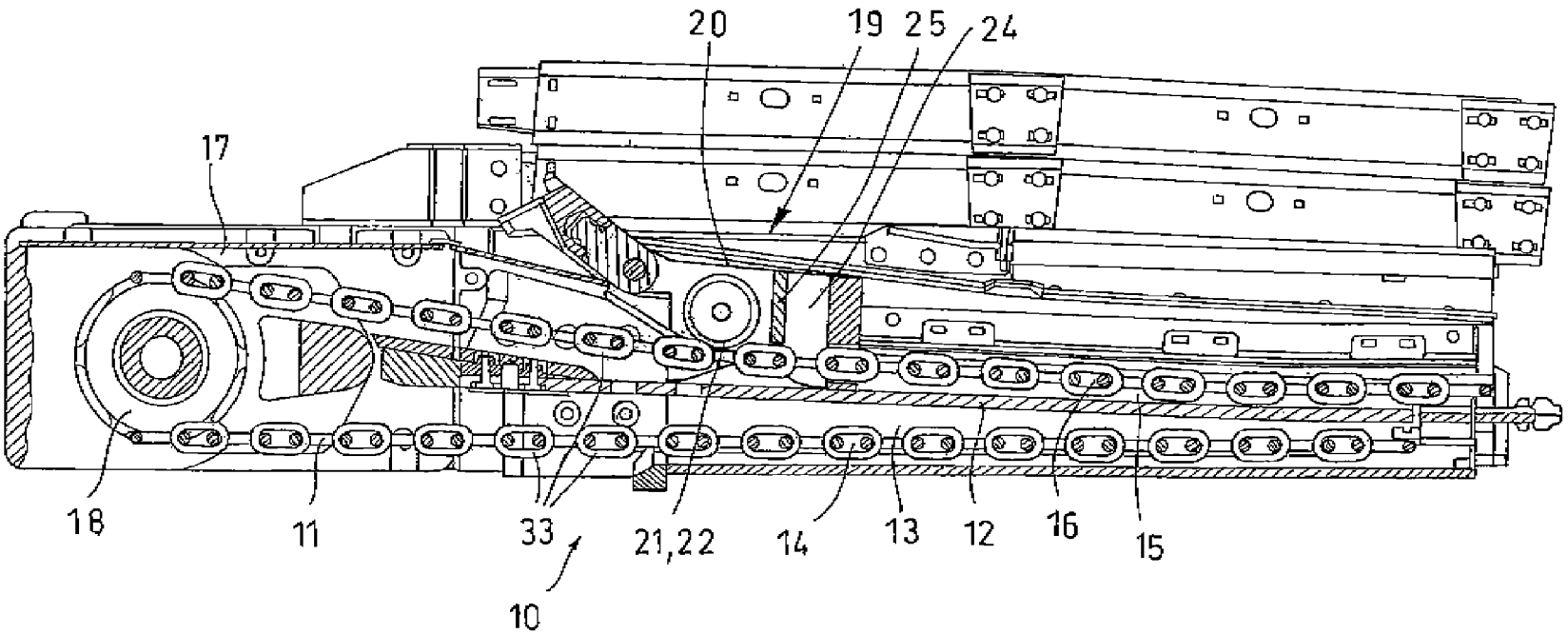
FIG. 1 shows a chain guide for a driving chain of a coal plow in longitudinal section.
Figure 2:
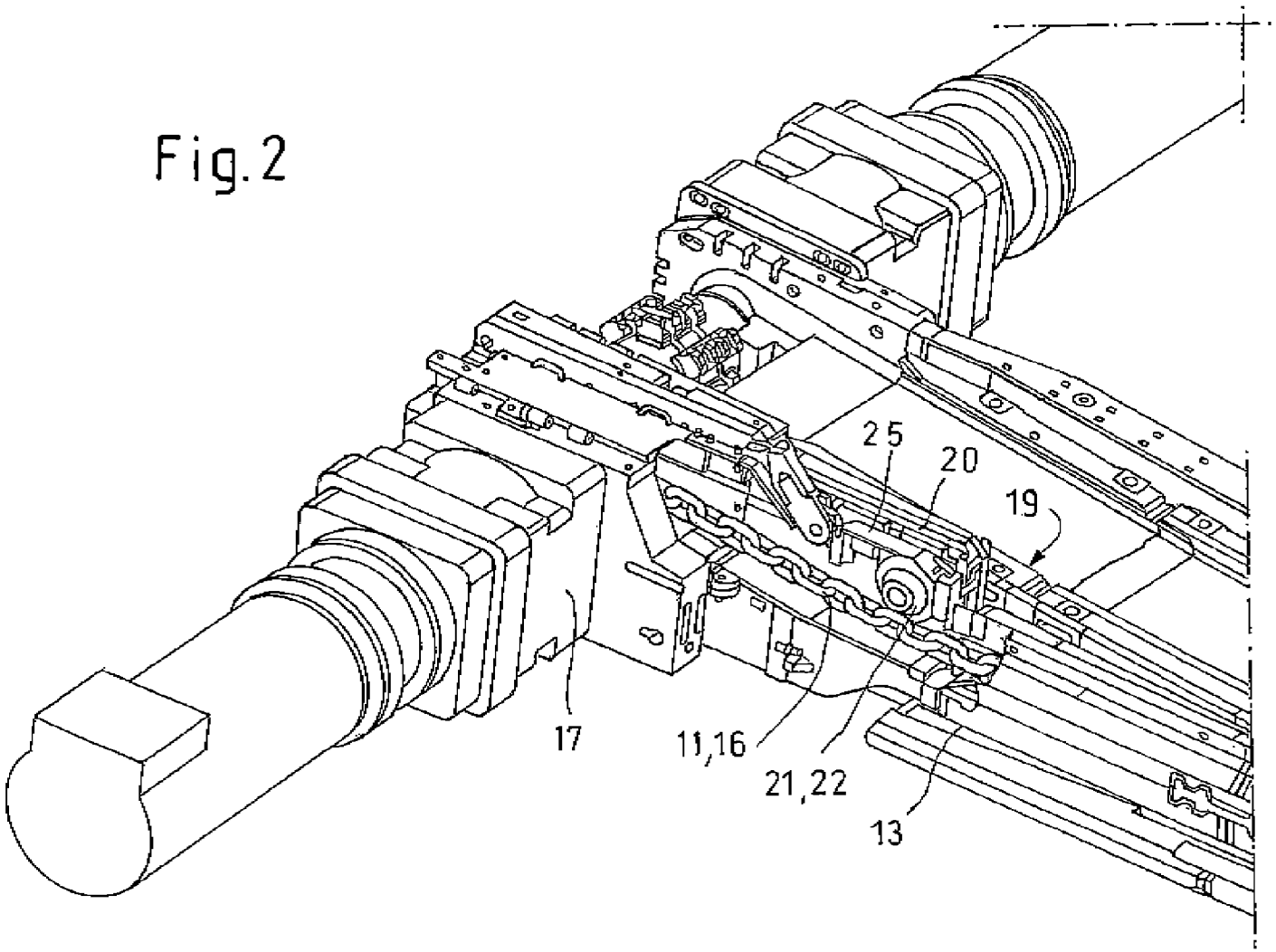
FIG. 2 shows a chain guide according to FIG. 1 in an oblique perspective illustration from above, partly in section.

Referring now to the drawings wherein the showings are for the purpose of illustrating preferred and alternative embodiments of the invention only and not for the purpose of limiting the same, FIGS. 1 and 2 show a scraper chain conveyor at one of its end regions, said scraper chain conveyor being provided, in a manner known per se, with a plow guide for a coal-winning plow. The plow (not shown) is driven by means of a driving chain 11 which is accommodated in a chain box 10 lying below the conveying plane.

To this end, the arrangement has a first chain passage 13 for the load strand 14 of the driving to chain and a second chain passage 15 through which the return strand 16 of the driving chain runs. Located at the end regions of the chain passages 13, 15 is a driving station 17 having a driving sprocket 18, around which the driving chain 11 is looped and with which the chain is pulled through the chain passages in a known manner. Arranged in the transition region 19 between the second chain passage 15 and the driving station 17 is a chain guide 20 having a chain guide element 21 which pushes the return strand of the chain downward and thereby deflects said return strand out of the chain passage for the return strand toward the driving sprocket 18 and which has a pressure roller 22, or consists substantially of such a pressure roller, which presses from above with its track 23 against the driving chain 11 and thereby deflects the chain toward the driving sprocket and keeps the chain under tension.

Figure 3:
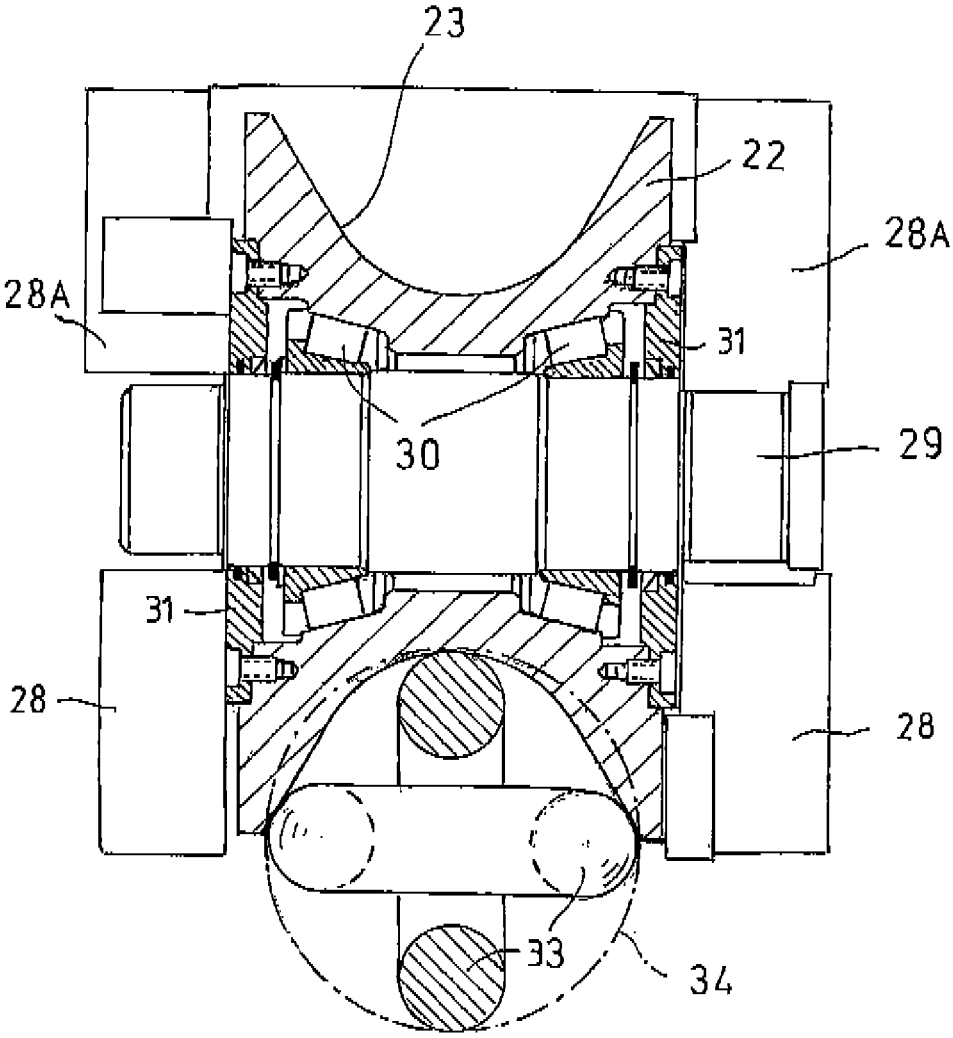
FIG. 3 shows the pressure roller used in the chain guide according to FIGS. 1 and 2, in section.
Figure 4:
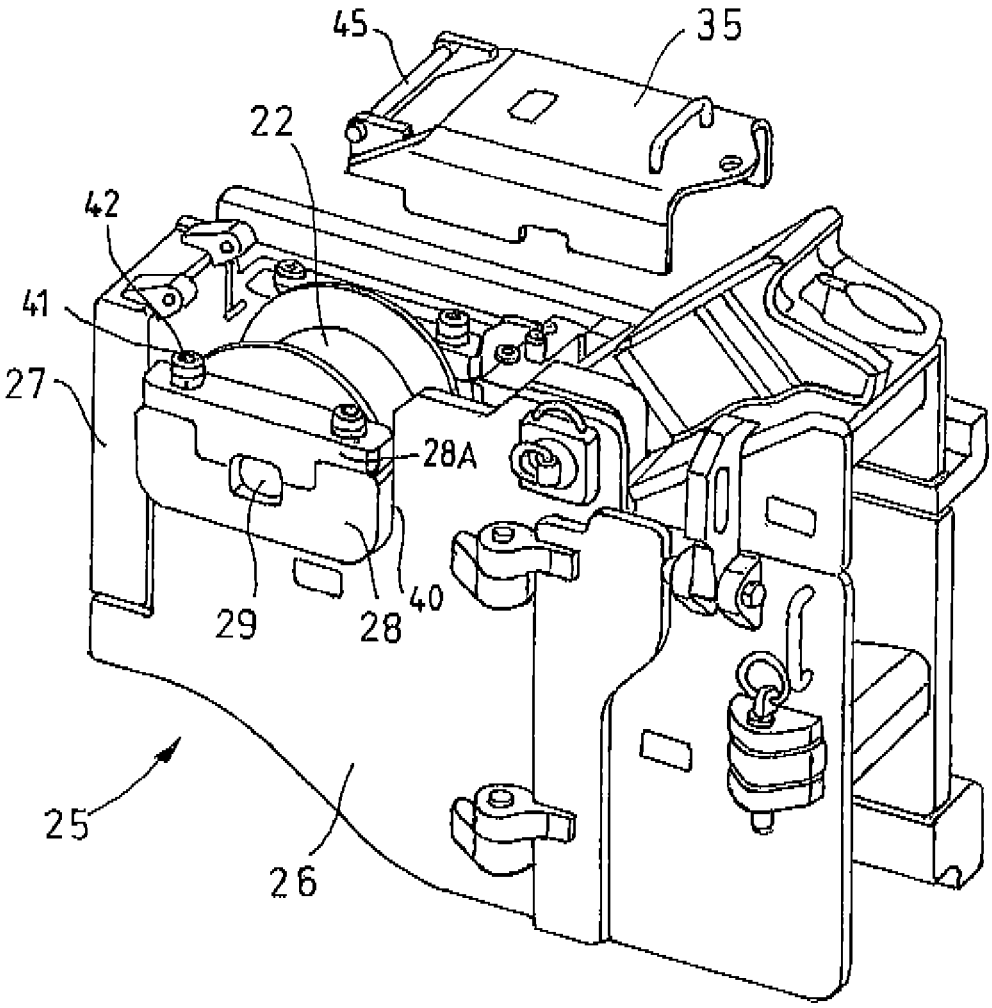
FIG. 4 shows an attachment which can be inserted in the chain guide according to FIGS. 1 and 2 and has a pressure roller accommodated therein, in a perspective illustration, according to a first embodiment variant.

The chain guide 20, which consists of an attachment 25 interchangeably fitted into a gap 24 above the chain passage 15 at the transition region 19 of the mining machine, is shown in more detail in a first embodiment in FIGS. 3 and 4. It can be seen that the attachment 25 consists of a housing having two side walls 26 and a rear end wall 27, wherein the two side walls 26 are provided with upwardly open recesses as accommodating pockets 40 for bearing blocks 28, 28A which accommodate a roller axle 29 for the pressure roller 22 in a rotationally fixed manner. The accommodating pocket 40 is defined at the rear by the end wall 27 and at the bottom and at the front by the respective side wall 26. Both bearing blocks 28, 28A are formed congruently with the circumferential wall of the accommodating pocket 40 and are accommodated in the latter in a form-fitting manner. The bottom bearing block 28, if need be, may also be fixedly anchored in the accommodating pocket and, for example, welded in place for this purpose. The top bearing block 28A, once the nuts 41 have been released from the two vertically disposed threaded rods 42 anchored in the bottom bearing block 28 or in the side wall 26, can be removed upward, as a result of which the roller axle 29 is exposed and can then also be removed together with the pressure roller 22 from the bottom bearing block 28 and exchanged for another pressure roller 22 plus roller axle 29.

The pressure roller 22 is rotatably mounted on the roller axle 29 with two tapered roller bearings 30 in back-to-back arrangement and is provided with lateral sealing covers 31 to prevent the ingress of coal dust or other contaminants. It can be seen in particular in FIG. 3 that the track 23 of the pressure roller 22 has a concave shape adapted to the envelope curve 34 defined by the chain links 33, such that the pressure roller, when it acts on the chain, not only keeps said chain under tension and deflects it, but at the same time also prevents lateral running of the chain.

During operation, the pressure roller 22 accommodated in the attachment 25 or in the accommodating pocket 24 is covered at the top by a hinged lid 35 which prevents, to the greatest possible extent, coal dust or rock fragments from reaching the roller but, after it has been opened, allows easy access to the pressure roller 22 and thus enables dust or other contaminants which have nonetheless settled in the region of the pressure roller and/or in the accommodating pocket to be removed again with simple means. If it should transpire during such an inspection that the functioning of the roller is no longer reliably ensured due to wear, said roller can be exchanged quickly and simply by the lid 35 mounted on one side on the hinge spindle 45 being swung open and then, as described above, by the bearing blocks 28, 28A being opened and by the pressure roller 22 together with its roller axle 29 being lifted out and exchanged for a new roller with roller axle. If both the bottom bearing block 28 and the top bearing block 28A sit loosely in the accommodating pocket 40, i.e. in such a way as to be removable upward here, the lid 35 can at the same time form the securing element which presses the bearing blocks 28, 28A downward into the accommodating pocket 40 and secures them against release. However, the lid 35 can also hold only the top bearing block 28A in the closed position.

Figure 5:
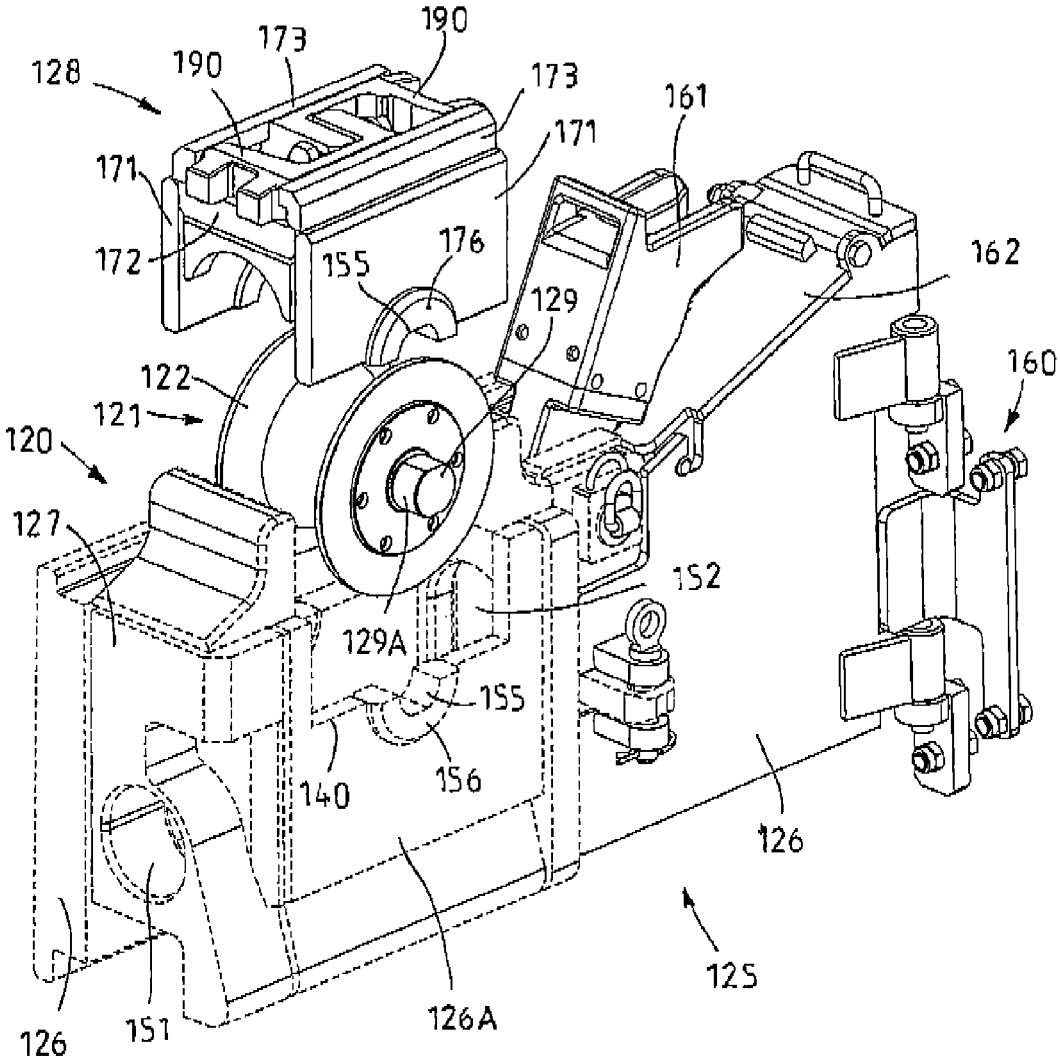
FIG. 5 shows an attachment which can be inserted in the chain guide according to FIGS. 1 and 2 and has a pressure roller accommodated therein, in a perspective exploded illustration, according to a second embodiment variant.
Figure 6:
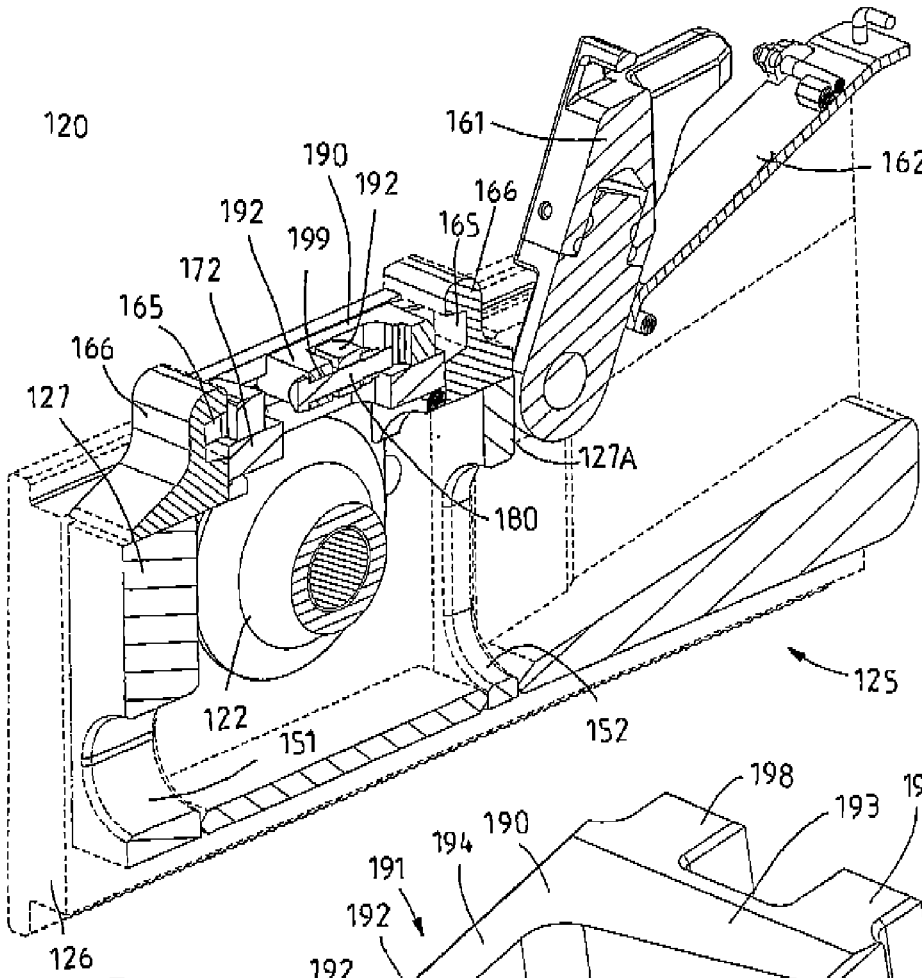
FIG. 6 shows a longitudinal section through the attachment according to FIG. 5 in the fitted state of the pressure roller.

FIGS. 5 and 6 show an alternative configuration of a chain guide 120 according to the invention, which again consists substantially of an attachment 125 which, via the side wall 126, here the rear side wall 126, designed as a bearing plate having strip-shaped edges, can be fastened to a spill plate, designed for accommodating the bearing plate, of a driving station of a plow installation. In the exemplary embodiment of the attachment 125 shown, the front side wall 126, only shown in FIG. 6, can be fastened to a spar or a side spill plate of the driving station via a tilting hinge 160, as a result of which, provided the retaining hooks for the rear side wall 126 are released, the entire attachment 125 can be pivoted in order to be able to carry out, for example, repair work on a scraper chain conveyor laid parallel to the plow installation. As in the previous exemplary embodiment, a catch 161 is also pivotably linked between the two chain walls 126 in the case of the attachment 125 in order to be able to secure the chain strand of the plow chain for repairs when the closing lid 162 is removed or swung up. An accommodating pocket 140 is again formed in the left-hand half of the attachment 125, in which accommodating pocket 140 a pressure roller 122 rotatably mounted on a bearing axle 129 and forming the actual chain guide element 121 can be interchangeably fastened, wherein the pressure roller 122 can be pressed in an adjustable manner, or with its track, as already described further above, against a plow chain (not shown in FIGS. 5 and 6). In the operating state, the plow chain passes through a passage opening 151 in the end wall 127, here the front end wall 127, and a passage opening 152 in the end wall 127A, here the rear end wall 127A. In the fitted state of the attachment 125 at the driving station, the top chain guide passage for the plow chain adjoins the front passage opening 151, whereas the plow chain behind the rear passage opening 152 enters the driving or return sprocket for the plow chain. With the pressure roller 122, the plow chain can be preloaded downward between both passage openings 151, 152, thereby enabling the top chain strand of the plow chain to enter the plow chain sprocket (not shown) with low wear in an optimum manner without the plow chain coming into contact with, for example, the edges of the rear passage opening 152. As in the previous exemplary embodiment, here, too, the pressure roller 122 and roller axle 129 are designed as a construction unit, for which reason the entire pressure roller 122 can be exchanged for another pressure roller without any problems and quickly if wear has occurred at the envelope curve of the pressure roller 122 or the mounting thereof.

In order to enable the pressure roller 122 together with roller axle 129 to be exchanged as simply as possible and at the same time achieve stable and reliable locking of the roller axle 129 even in the event of disproportionately high vertical forces on the pressure roller 122, the roller axle 129, with its two axle journals 129A which project laterally beyond the pressure roller 122, is inserted in axle receptacles 155 in a rotationally fixed manner, wherein the bottom axle receptacle 155 is formed directly on a wall section 126A of the side wall 126, here the front side wall 126, and the rear bottom axle receptacle is formed on a rear wall section in the rear side wall 126. In this case, the axle receptacle 155 can either consist of a correspondingly integrally formed recess in the wall section 126A or, as shown in FIG. 5, can be formed inside a ring segment 156 which is welded to the wall section 126A and could also be exchanged in the event of repair if the axle receptacle 155 is worn. The axle receptacle 155 together with ring segment 156 therefore forms a bottom bearing block in the attachment 125 of the chain guide 120, this bearing block being formed fixedly and in one piece on the attachment 125, whereas only a top bearing block designated overall by reference numeral 128 can be removed. The top bearing block 128 at the same time forms the lid for the pressure roller 122, and the bearing block 128 has two side webs 171 which in this case have a rectangular cross section and can be inserted in an accurately form-fitting manner into the correspondingly congruently designed accommodating pockets 140 in the wall sections 126A. Both side webs 171 are provided at their bottom edge with further ring segments 176, which, like the bottom ring segments 156 on the wall sections 126A, each form one half of the axle receptacle, here therefore the top half of the axle receptacle 155, and, in the fitted state, accommodate the axle journal 129A in a rotationally fixed manner between both ring segments 156, 176, said axle journal 129A having a noncircular, preferably approximately oval cross section in the exemplary embodiment shown.

The bearing block 128 designed as a lid is provided with a cover web 172 which connects the two side webs 171 and above which two lateral, approximately L-shaped hook strips 173 are welded on, which form, with their undercut sections, sliding guides for two sliding bolts 190 of identical design, with which the locking position of the top bearing block 128 can be secured in order to prevent unintentional release of the bearing block 128 and in this respect also the displacement of the roller axle 129 of the pressure roller 122.

Figure 7:
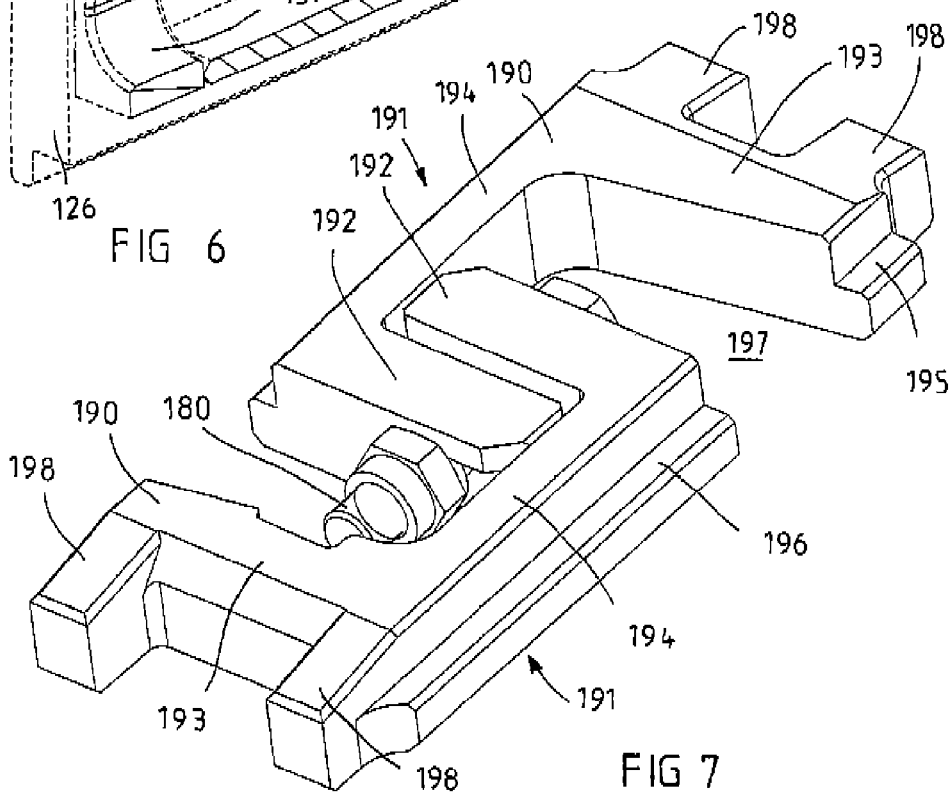
FIG. 7 shows a perspective detailed view of the sliding bolt pair.

Reference will now first be made to FIG. 7, in which the two sliding bolts 190 of identical design, which are used as a pair of sliding bolts 190, are shown. Each sliding bolt 190 has a substantially U-shaped basic body 191 having a short marginal leg 192, a longer marginal leg 193 and an intermediate leg 194 which runs perpendicularly to both marginal legs 192, 193. Both the intermediate leg 194 and the end face of the longer marginal leg 193 are each provided at the margin with a step, as a result of which guide strips 195 and 196 are formed on the marginal leg 193 and intermediate leg 194, respectively, with which the sliding bolts 190 can each be secured in a form-fitting manner to the strips (173, FIG. 5), forming the sliding guide, in such a way as to be guided in a vertically fixed and horizontally movable manner. The shorter marginal leg 192 in each case is dimensioned in such a way that, in the fitted state, the guide strip 196 on the intermediate leg 194 and the substantially shorter guide strip 195 on the end face of the marginal leg 193 lie such as to be plane-parallel relative to one another. Due to the U-shaped configuration, the respectively shorter marginal leg 192 plunges into the intermediate space 197 between the two marginal legs 192, 193, and the distance between the two longer marginal legs 193 can be reduced by pushing apart the two shorter marginal legs 192. Only in this position, which is not shown in the figure, can the top bearing block (128, FIG. 5) be fitted or removed in the accommodating pocket in order to open or close the mounting for the roller axle (129, FIG. 5). To lock the bearing block by a form fit, the longer marginal legs 193 are provided on the outside with locking lugs 198, the top sides of which taper in a wedge shape toward the free ends and which, for locking the bearing block 128, as shown in FIG. 6, to engage in locking pockets 165 which are formed on retaining blocks 166, which in turn are fitted on the top surfaces of the two end walls 127, 127A with locking pockets 165 facing one another.

In order to prevent the sliding bolts 190 from being released from one another and from the locking position, even during vibrations, and at the same time in order to be able to apply as high a clamping force as possible, in each case the shorter marginal leg 192 is provided with a through-hole 199, through which a clamping screw 180 passes. The distance between the two shorter marginal legs 192 can be reduced via the clamping screw 180, as a result of which the distance between the two outer, longer marginal legs 193 increases and the locking lugs 198 engage correspondingly deeper in the locking pockets 165.

The invention is not restricted to the exemplary embodiments shown and described, but rather various modifications and additions are conceivable without departing from the scope of the invention. It is thus possible, for example, to provide a plurality of pressure rollers arranged one behind the other in the passage direction of the chain in order to provide a guide for the chain over a longer distance, said guide working largely free of wear. It is also possible to adjust the pressure roller against the chain under the effect of a spring element and/or of a shock absorber, whereby reliable contact between roller and chain is always ensured, even during shock-like loads on the driving chain. The chain guide according to the invention can alternatively or additionally act on the load strand of the driving chain and is of course suitable not only for a plow chain but also, for example, for driving chains of scraper chain conveyors. The bearing blocks can also be inserted in accommodating pockets which are formed directly on the side cheeks of the driving or return stations.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A chain guide for a driving chain of a mining machine, in particular for a plow chain on a winning plow, having at least one of a driving and a return station arrangable on an end region of the mining machine, the at least one driving and return station having a sprocket for the driving chain, the driving chain having a load strand and a return strand, the chain guide comprising at least one chain guide element which is arranged in spatial proximity to the sprocket at the at least one station, the chain guide element having at least one pressure roller which has a concave track adapted to a curve defined by the chain links, the at least one pressure roller being rotatably mounted on a roller axle and is exchangable together with the roller axle;

wherein the at least one pressure roller is arranged on an attachment which is insertable proximate at least one of the driving and return station, the attachment comprising a housing having side walls defining upwardly open recesses that accommodate the roller axle.

2. The chain guide as claimed in claim 1, wherein the roller axle of the at least one pressure roller is supported on bearing blocks disposed at least partially within the upwardly open recesses.

3. The chain guide as claimed in claim 2, wherein the bearing blocks are interchangeably fitted in an accommodating pocket defined by the upwardly open recesses.

4. The chain guide as claimed in claim 3, wherein the bearing blocks are secured against release in the accommodating pocket by a hinged lid.

5. The chain guide as claimed in claim 3, wherein the bearing blocks are secured against release in the accommodating pocket by at least one sliding bolt.

6. The chain guide as claimed in claim 5, wherein the bearing blocks include a top bearing block and the top bearing block is provided with sliding guides for the at least one sliding bolt.

7. The chain guide as claimed in claim 6, further including retaining blocks having locking pockets which face one another and are fitted above the accommodating pocket, the at least one sliding bolt further including locking lugs which are configured to engage the locking pockets in a locking state in order to at least partially secure the top bearing block against release in the accommodating pocket.

8. The chain guide as claimed in claim 6, wherein the at least one sliding bolt is a pair of sliding bolts, each sliding bolt of the pair of sliding bolts having a U-shaped basic body including three legs, the three legs including a first marginal leg and an intermediate leg having outer sides facing away from one another with guide strips for form-fitting engagement in the sliding guides, the each sliding bolts further including a second marginal leg having a through-hole for a securing screw to join the pair of sliding bolts together.

9. The chain guide as claimed in claim 1, the attachment further including a top bearing block, and two sliding bolts configured to lock the position of the top bearing block.

10. The chain guide as claimed in claim 1, further including a bottom axle receptacle for the roller axle which is arranged proximate a bottom of an accommodating pocket, the bottom axle receptacle being a part of the attachment.

* * * * *

UNITED STATES PATENT AND TRADEMARK OFFICE

CERTIFICATE OF CORRECTION

PATENT NO. : 8,544,960 B2
APPLICATION NO. : 12/989049
DATED : October 1, 2013
INVENTOR(S) : Klabisch et al.

It is certified that error appears in the above-identified patent and that said Letters Patent is hereby corrected as shown below:

In the Specification

Column 3, line 43, delete “driving to chain” and insert -- driving chain --.

Column 6, line 37, delete “FIG. 6, to engage” and insert -- FIG. 6, engage --.

Signed and Sealed this
Eighteenth Day of August, 2015

Michelle K. Lee

Michelle K. Lee
*Director of the United States Patent and Trademark Office*